US007033287B2

(12) United States Patent
Aoyama et al.

(10) Patent No.: US 7,033,287 B2
(45) **Date of Patent: *Apr. 25, 2006**

(54) GOLF BALL WITH IMPROVED FLIGHT PERFORMANCE

(75) Inventors: Steven Aoyama, Marion, MA (US); Douglas E. Jones, Dartmouth, MA (US)

(73) Assignee: Acushnet Company, Fairhaven, MA (US)

( * ) Notice: Subject to any disclaimer, the term of this patent is extended or adjusted under 35 U.S.C. 154(b) by 11 days.

This patent is subject to a terminal disclaimer.

(21) Appl. No.: 10/964,449

(22) Filed: Oct. 13, 2004

(65) Prior Publication Data

US 2005/0079931 A1 Apr. 14, 2005

Related U.S. Application Data

(63) Continuation of application No. 10/337,275, filed on Jan. 6, 2003.

(51) Int. Cl.
*A63B 37/12* (2006.01)

(52) U.S. Cl. ..... 473/383

(58) Field of Classification Search ..... 473/378–385
See application file for complete search history.

(56) References Cited

U.S. PATENT DOCUMENTS

| | | | | |
|---|---|---|---|---|
| 4,744,564 | A | 5/1988 | Yamada | 273/232 |
| 4,804,189 | A | 2/1989 | Gobush | 273/232 |
| 4,949,976 | A | 8/1990 | Gobush | 273/232 |
| 5,060,954 | A | 10/1991 | Gobush | 273/232 |
| 5,072,945 | A | 12/1991 | Oka et al. | 273/232 |
| 5,090,705 | A | 2/1992 | Oka et al. | 273/232 |
| 5,158,300 | A | 10/1992 | Aoyama | 273/232 |
| 5,273,287 | A | 12/1993 | Molitor et al. | 273/232 |
| 5,338,038 | A | 8/1994 | Cadorniga | 273/216 |
| 5,467,994 | A | 11/1995 | Moriyama et al. | 273/222 |
| 5,482,286 | A | 1/1996 | Molitor et al. | 273/230 |
| 5,503,397 | A | 4/1996 | Molitor et al. | 273/230 |
| 5,507,493 | A | 4/1996 | Sullivan et al. | 273/230 |
| 5,569,100 | A | 10/1996 | Molitor et al. | 473/384 |
| 5,766,098 | A | 6/1998 | Molitor et al. | 473/377 |
| 5,779,562 | A | 7/1998 | Melvin et al. | 473/373 |
| 5,800,287 | A | 9/1998 | Yokota et al. | 473/372 |
| 5,833,554 | A | 11/1998 | Sullivan et al. | 473/374 |
| 5,846,141 | A | 12/1998 | Morgan et al. | 473/377 |
| 5,906,551 | A | 5/1999 | Kasashima et al. | 473/384 |
| 5,908,359 | A * | 6/1999 | Shimosaka et al. | 473/384 |
| 5,957,786 | A | 9/1999 | Aoyama | 473/379 |
| 5,967,908 | A | 10/1999 | Yamagishi et al. | 473/373 |
| 6,056,650 | A | 5/2000 | Yamagishi et al. | 473/384 |
| 6,102,816 | A | 8/2000 | Sullivan et al. | 473/374 |
| 6,200,232 | B1 | 3/2001 | Kasashima et al. | 473/384 |
| 6,213,898 | B1 | 4/2001 | Ogg | 473/383 |
| 6,224,499 | B1 | 5/2001 | Ogg | 473/383 |
| 6,290,615 | B1 | 9/2001 | Ogg | 473/378 |

(Continued)

*Primary Examiner*—Raeann Gorden
(74) *Attorney, Agent, or Firm*—Kristin D. Wheeler

(57) ABSTRACT

A golf ball is provided that has improved aerodynamic efficiency, resulting in increased flight distance for golfers of all swing speeds, and more particularly for golfers possessing very high swing speeds, such as those who can launch the balls at an initial speed greater than 160 miles per hour and more particularly at initial ball speed of about 170 miles per hour or higher. The golf ball of the present invention combines lower dimple count with multiple dimple sizes to provide higher dimple coverage and improved aerodynamic characteristics.

15 Claims, 4 Drawing Sheets

U.S. PATENT DOCUMENTS 6,331,150 B1 12/2001 Ogg ..... 473/383
6,358,161 B1 3/2002 Aoyama ..... 473/383
6,461,253 B1 10/2002 Ogg ..... 473/378
6,464,601 B1 10/2002 Ogg ..... 473/383
2004/0132550 A1* 7/2004 Aoyama et al. ..... 473/378
2004/0132551 A1* 7/2004 Aoyama et al. ..... 473/378

* cited by examiner

GOLF BALL WITH IMPROVED FLIGHT PERFORMANCE

CROSS REFERENCE TO RELATED APPLICATIONS

This application is a continuation of U.S. application Ser. No. 10/337,275, filed on Jan. 6, 2003, the entirety of which is incorporated by reference herein.

FIELD OF THE INVENTION

The present invention relates to golf balls having improved aerodynamic characteristics that yield improved flight performance and longer ball flight.

BACKGROUND OF THE INVENTION

The flight of a golf ball is determined by many factors; however, most of these factors are outside of the control of a golfer. While a golfer can control the speed, the launch angle, and the spin rate of a golf ball by hitting the ball with a particular club, the distance that the ball travels after impact depends upon ball aerodynamics, construction and materials, as well as environmental conditions, e.g., terrain and weather. Since flight distance and consistency are critical factors in reducing golf scores, manufacturers continually strive to make improvements in golf ball flight consistency and flight distance through improving various aerodynamic properties and golf ball constructions.

Before the 1970s, most golf balls had 336 dimples arranged in an octahedron pattern, and had dimple coverage in the range of about 60–65%. During the 1970s, there was a trend toward dimple patterns that cover a relatively large proportion of the surface of the ball. These golf balls typically had about the same number of dimples (332) arranged into an icosahedron pattern. These dimples typically had the same size and provided about 70% coverage or more of the ball's surface. This provided a measurable improvement in flight distance. Beginning in the 1980s, there has been an additional shift toward larger number of dimples on the ball and multiple sizes of dimples on the ball. This trend toward higher dimple count during the 1980s was so strong that it was sometimes perceived as a "dimple war" among golf ball manufacturers.

These trends have cooperated to produce today's typical golf ball configuration, which has about 400 dimples in 2–5 different sizes and covers about 80% of the ball's surface. For example, the USGA uses the Pinnacle Gold LS as its standard setup golf ball. This ball has a 392-dimple pattern disclosed in U.S. Pat. No. 5,957,786 with five sizes of dimples. In the past, aerodynamic and other performance characteristics of golf balls have been designed to suit the needs of various types of golfers from casual recreational players to highly skilled professionals. A typical distinguishing factor among these golfers is their swing speed. Professionals have generally defined the upper end of the range, with swing speeds sufficient to generate initial ball speed of around 160 miles per hour. Recently, the game of golf has attracted world class athletes due in part to increased prize money. Professional golfers are bigger, stronger and more aggressive than ever before. As a result, it is not unusual to see professionals and some amateurs who can generate initial ball speeds in excess of 170 miles per hour. However, there is no teaching in the art for a golf ball that is optimal for all ball speeds, including the very high ball speeds generated by today's players.

Hence, there remains a need for golf balls designed for increased distance for all golfers, including high swing speed golfers.

SUMMARY OF THE INVENTION

The present invention is directed to golf balls having improved aerodynamic efficiency, resulting in increased flight distance for golfers of all swing speeds, and more particularly for golfers possessing very high swing speeds, such as those who can launch the balls at an initial speed greater than 160 miles per hour and more particularly at initial ball speed of about 170 miles per hour or higher.

In particular, the present invention is directed to the selection of dimple arrangements and dimple profiles that can improve aerodynamic efficiency, particularly at high swing speeds. More particularly, the present invention combines the lower dimple count of earlier golf balls with higher dimple coverage and multiple sizes of the more recent balls.

In accordance to a preferred embodiment, the present invention is directed to a golf ball having an outer surface, wherein the outer surface comprises less than about 370 dimples covering at least about 80% of the outer surface of the golf ball and wherein the dimples comprise at least two sizes. Preferably, the golf ball comprises less than 350 dimples and more preferably less than 340 dimples. Alternatively, the golf ball comprises about 250 dimples. Preferably, the dimples cover at least about 83% of the surface of the ball, and comprise at least four sizes and more preferably at least six sizes.

The preferred golf ball may have a ratio of coefficient of aerodynamic force at Reynolds Number of 180,000 and spin ratio of 0.110 to coefficient of aerodynamic force at Reynolds Number of 70,000 and spin ratio of 0.188 of about 0.780 or less, and more preferably this ratio is less than about 0.760 or less. In accordance to one aspect of the present invention, the aerodynamic force coefficient at Reynolds Number of 180,000 and spin ratio of 0.110 is about 0.290 or less. In accordance to another aspect of the present invention, the aerodynamic force coefficient at Reynolds Number of 70,000 and spin ratio of 0.188 is about 0.370 or more.

The preferred golf ball may also have a ratio of lift coefficient at Reynolds Number of 180,000 and spin ratio of 0.110 to lift coefficient at Reynolds Number of 70,000 and spin ratio of 0.188 of about 0.730 or less. Preferably, this ratio is about 0.725 or less, more preferably about 0.700 or less, and most preferably about 0.690. In accordance to one aspect of the present invention, the lift coefficient at Reynolds Number of 180,000 and spin ratio of 0.110 is about 0.170 or less. In accordance to another aspect of the present invention, the lift coefficient at Reynolds Number of 70,000 and spin ratio of 0.188 is about 0.240 or more. In accordance to yet another aspect of the present invention, the drag coefficient at Reynolds Number of 70,000 and spin ratio of 0.188 is about 0.270 or less.

The preferred golf ball may comprise a two-layer core and a two-layer cover. Preferably, the innermost core layer has a diameter in the range of about 0.375 inch to about 1.4 inches, and the outer core has an outer diameter in the range of about 1.4 inches to about 1.62 inches. Preferably, the inner cover has an outer diameter in the range of about 1.59 inches to about 1.66 inches. The preferred golf ball has a coefficient of restitution of greater than 0.800.

In accordance to another preferred embodiment, the present invention is directed to a golf ball having an outer surface, wherein the outer surface comprises less than about 370 dimples and wherein the total dimple volume is at least about 1.25%. Preferably, the total dimple volume is at least about 1.5%. Preferably, the golf ball comprises less than 350 dimples, and more preferably less than 340 dimples. Alternatively, the golf ball comprises less than 300 dimples or may comprise about 250 dimples. The dimples on the preferred golf ball cover at least about 75% of the surface of the ball, preferably at least about 80% of the surface of the ball, and more preferably at least about 83% of the surface of the ball.

In accordance to another preferred embodiment, the present invention is directed to a golf ball having an outer surface, wherein the outer surface comprises a plurality of dimples and wherein said golf ball has a ratio of aerodynamic coefficient at Reynolds Number of 180,000 and spin ratio of 0.110 to aerodynamic coefficient at Reynolds Number of 70,000 and spin ratio of 0.188 of about 0.780 or less. Preferably, this ratio is about 0.760 or less. In accordance to one aspect of the present invention, the aerodynamic coefficient at Reynolds Number of 180,000 and spin ratio of 0.110 is about 0.290 or less. In accordance to another aspect of the present invention, the aerodynamic coefficient at Reynolds Number of 70,000 and spin ratio of 0.188 is about 0.370 or more. This preferred golf ball has a compression greater than about 90 PGA and comprises less than about 370 dimples.

In accordance to yet another preferred embodiment, the present invention is directed to a golf ball having an outer surface, wherein the outer surface comprises a plurality of dimples and wherein said golf ball has a ratio of lift coefficient at Reynolds Number of 180,000 and spin ratio of 0.110 to lift coefficient at Reynolds Number of 70,000 and spin ratio of 0.188 of about 0.730 or less. Preferably, this ratio is about 0.725 or less, more preferably about 0.700 or less and most preferably about 0.690 or less. In accordance to one aspect of the present invention, the lift coefficient at Reynolds Number of 180,000 and spin ratio of 0.110 is about 0.170 or less. In accordance to another aspect of the present invention, the lift coefficient at Reynolds Number of 70,000 and spin ratio of 0.188 is about 0.240 or more.

In accordance to yet another preferred embodiment, the present invention is directed to a golf ball having an outer surface, wherein the outer surface comprises a plurality of dimples and wherein said golf ball has a drag coefficient at Reynolds Number of 70,000 and spin ratio of 0.188 of about 0.270 or less. The preferred golf ball comprises less than 370 dimples and preferably less than 300 dimples. The dimples preferably cover at least about 80% of the surface area of the golf ball and more preferably at least about 83% of the surface area of the golf ball.

In accordance to yet another preferred embodiment, the present invention is directed to a golf ball having an outer surface, wherein the outer surface comprises less than about 300 dimples covering at least about 75% of the outer surface of the golf ball. Preferably, the ball comprises less than about 275 dimples and more preferably about 250 dimples. Preferably, the dimples comprise at least two sizes, more preferably at least four sizes and most preferably at least six sizes. The dimples preferably cover at least about 80% of the surface of the ball, and more preferably at least about 83% of the surface of the ball.

Element(s) or component(s) of each preferred embodiment can be used in combination with other preferred embodiments.

BRIEF DESCRIPTION OF THE DRAWINGS

These and other aspects of the present invention may be more fully understood with reference to, but not limited by, the following drawings.

DETAILED DESCRIPTION OF THE INVENTION

Figure 1:
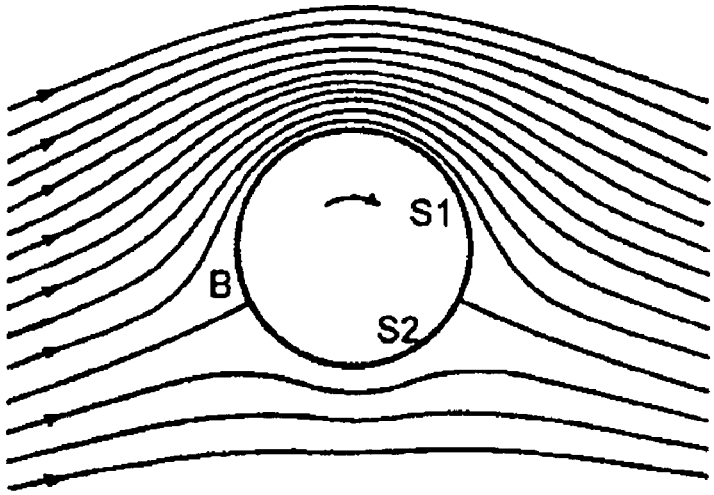
FIG. 1 illustrates air flow around a golf ball in flight.

Aerodynamic forces acting on a golf ball are typically resolved into orthogonal components of lift and drag. Lift is defined as the aerodynamic force component acting perpendicular to the flight path. It results from a difference in pressure created by a distortion in the air flow caused by the backspin of the ball. A boundary layer forms at the stagnation point of the ball, B, then grows and separates at points S1 and S2, as shown in FIG. 1. Due to the backspin, the top of the ball moves in the direction of the airflow, which retards the separation of the boundary layer. In contrast, the bottom of the ball moves against the direction of airflow, thus advancing the separation of the boundary layer at the bottom of the ball. Therefore, the position of separation of the boundary layer at the top of the ball, S1, is further back than the position of separation of the boundary layer at the bottom of the ball, S2. This asymmetrical separation creates an arch in the flow pattern, requiring the air over the top of the ball to move faster and, thus, have lower pressure than the air underneath the ball.

Drag is defined as the aerodynamic force component acting parallel to the ball flight direction. As the ball travels through the air, the air surrounding the ball has different velocities and, accordingly, different pressures. The air exerts maximum pressure at the stagnation point, B, on the front of the ball, as shown in FIG. 1. The air then flows over the sides of the ball and has increased velocity and reduced pressure. The air separates from the surface of the ball at points S1 and S2, leaving a large turbulent flow area with low pressure, i.e., the wake. The difference between the high pressure in front of the ball and the low pressure behind the ball reduces the ball speed and acts as the primary source of drag for a golf ball.

The dimples on a golf ball are used to adjust drag and lift properties of a golf ball and, therefore, most ball manufacturers research dimple patterns, shape, volume, and cross-section to improve overall flight distance of a golf ball. The dimples create a thin turbulent boundary layer around the ball. The turbulence energizes the boundary layer and aids in maintaining attachment to and around the ball to reduce the area of the wake. The pressure behind the ball is increased and the drag is substantially reduced.

The present invention is described herein in terms of aerodynamic criteria that are defined by the magnitude and direction of the aerodynamic forces, for the range of Spin Ratios and Reynolds Numbers that encompass the flight regime for typical golf ball trajectories. These aerodynamic criteria and forces are described below.

Figure 2:
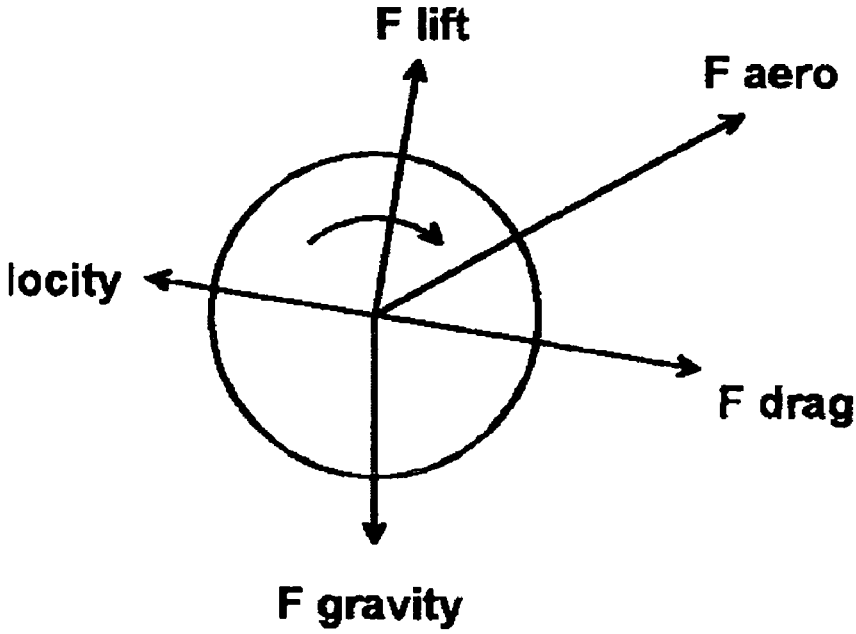
FIG. 2 illustrates the forces acting on a golf ball in flight.

The forces acting on a golf ball in flight are enumerated in Equation 1 and illustrated in FIG. 2:

$$F=F_L+F_D+F_G \quad \text{(Eq. 1)}$$

Where F=total force vector acting on the ball $F_L$=lift force vector $F_D$=drag force vector $F_G$=gravity force vector The lift force vector ($F_L$) acts in a direction dictated by the cross product of the spin vector and the velocity vector. The drag force vector ($F_D$) acts in a direction that is directly opposite the velocity vector. The magnitudes of the lift and drag forces of Equation 1 are calculated in Equations 2 and 3, respectively:

$$F_L=0.5C_L\rho AV^2 \quad \text{(Eq. 2)}$$

$$F_D=0.5C_D\rho AV^2 \quad \text{(Eq. 3)}$$

where ρ=density of air (slugs/ft$^3$)

A=projected area of the ball (ft$^2$) ($(\pi/4)D^2$)

D=ball diameter (ft)

V=ball speed (ft/s)

$C_L$=dimensionless lift coefficient $C_D$=dimensionless drag coefficient

Lift and drag coefficients are typically used to quantify the force imparted to a ball in flight and are dependent on air density, air viscosity, ball speed, and spin rate. The influence of all these parameters may be captured by two dimensionless parameters: Spin Ratio (SR) and Reynolds Number ($N_{Re}$). Spin Ratio is the rotational surface speed of the ball divided by ball speed. Reynolds Number quantifies the ratio of inertial to viscous forces acting on the golf ball moving through air. SR and $N_{Re}$ are calculated in Equations 4 and 5 below:

$$SR=\omega(D/2)/V \quad \text{(Eq. 4)}$$

$$N_{Re}=DV\rho/\mu \quad \text{(Eq. 5)}$$

where ω=ball rotation rate (radians/s) (2π(RPS))

RPS=ball rotation rate (revolution/s)

V=ball speed (ft/s)

D=ball diameter (ft)

ρ=air density (slugs/ft$^3$)

μ=absolute viscosity of air (lb/ft-s).

There are a number of suitable methods for determining the lift and drag coefficients for a given range of SR and $N_{Re}$, which include the use of indoor test ranges with ballistic screen technology. U.S. Pat. No. 5,682,230, the entire disclosure of which is incorporated by reference herein, teaches the use of a series of ballistic screens to acquire lift and drag coefficients. U.S. Pat. Nos. 6,186,002 and 6,285,445, also incorporated in their entirety by reference herein, disclose methods for determining lift and drag coefficients for a given range of velocities and spin rates using an indoor test range, wherein the values for $C_L$ and $C_D$ are related to SR and $N_{Re}$ for each shot. One skilled in the art of golf ball aerodynamics testing could readily determine the lift and drag coefficients through the use of an indoor test range, or alternatively in a wind tunnel.

The aerodynamic property of a golf ball can be quantified by two parameters that account for both lift and drag simultaneously: (1) the magnitude of aerodynamic force ($C_{mag}$), and (2) the direction of the aerodynamic force (Angle). It has now been discovered that flight performance improvements are attained when the dimple pattern and dimple profiles are selected to satisfy preferred magnitude and direction criteria. The magnitude and angle of the aerodynamic force are related to the lift and drag coefficients and, therefore, the magnitude and angle of the aerodynamic coefficients are used to establish the preferred criteria. The magnitude and the angle of the aerodynamic coefficients are defined in Equations 6 and 7 below:

$$C_{mag}=\sqrt{(C_L^2+C_D^2)} \quad \text{(Eq. 6)}$$

$$\text{Angle}=\tan^{-1}(C_L/C_D) \quad \text{(Eq. 7)}$$

To ensure consistent flight performance regardless of ball orientation, the percent deviation of $C_{mag}$ for each SR and $N_{Re}$ plays an important role. The percent deviation of $C_{mag}$ may be calculated in accordance with Equation 8, wherein the ratio of the absolute value of the difference between the $C_{mag}$ for any two orientations to the average of the $C_{mag}$ for these two orientations is multiplied by 100.

$$\text{Percent deviation } C_{mag}=|(C_{mag1}-C_{mag2})|/((C_{mag1}+C_{mag2})/2)*100 \quad \text{(Eq. 8)}$$

where $C_{mag1}=C_{mag}$ for orientation 1, and $C_{mag2}=C_{mag}$ for orientation 2.

To achieve the consistent flight performance, the percent deviation is preferably about 6 percent or less. More preferably, the deviation of $C_{mag}$ is about 3 percent or less.

Aerodynamic asymmetry typically arises from parting lines inherent in the dimple arrangement or from parting lines associated with the manufacturing process. The percent $C_{mag}$ deviation is preferably obtained using $C_{mag}$ values measured with the axis of rotation normal to the parting line plane, commonly referred to as a poles horizontal, "PH" orientation and $C_{mag}$ values measured in an orientation orthogonal to PH, commonly referred to as a pole over pole, "PP" orientation. The maximum aerodynamic asymmetry is generally measured between the PP and PH orientation.

The percent deviation of $C_{mag}$ as outlined above applies to the orientations, PH and PP, as well as any other two orientations. For example, if a particular dimple pattern is used having a great circle of shallow dimples, different orientations should be measured. The axis of rotation to be used for measurement of symmetry in the above example scenario would be normal to the plane described by the great circle and coincident to the plane of the great circle.

It has also been discovered that the $C_{mag}$ and Angle criteria for golf balls with a nominal diameter of 1.68 and a nominal weight of 1.62 ounces may be advantageously scaled to obtain the similar optimized criteria for golf balls of any size and weight. Any preferred aerodynamic criteria may be adjusted to obtain the $C_{mag}$ and angle for golf balls of any size and weight in accordance with Equations 9 and 10.

$$C_{mag(ball)}=C_{mag(nominal)}/((\sin(\text{Angle}_{(nominal)})*(W_{ball}/1.62)*(1.68/D_{ball})^2)^2+(\cos(\text{Angle}_{(nominal)})^2) \quad \text{(Eq. 9)}$$

$$\text{Angle}_{(ball)}=\tan^{-1}(\tan(\text{Angle}_{(nominal)})*(W_{ball}/1.62)*(1.68/D_{ball})^2) \quad \text{(Eq. 10)}$$

Also as used herein, the term "dimple" may include any texturizing on the surface of a golf ball, e.g., depressions and extrusions. Some non-limiting examples of depressions and extrusions include, but are not limited to, spherical depressions, meshes, raised ridges, and brambles. The depressions and extrusions may take a variety of shapes, such as circular, polygonal, oval, or irregular. Dimples that have multi-level configurations, i.e., dimple within a dimple, are also contemplated by the invention to obtain desirable aerodynamic characteristics.

At high speed, the aerodynamic drag force acting on golf ball in flight is even more important than at lower flight speed, because this force is proportional to the square of the ball speed. Hence, for players who have very high swing speed, the aerodynamic design of their golf ball is very important to maximize the distance that the ball may travel.

Figure 3:
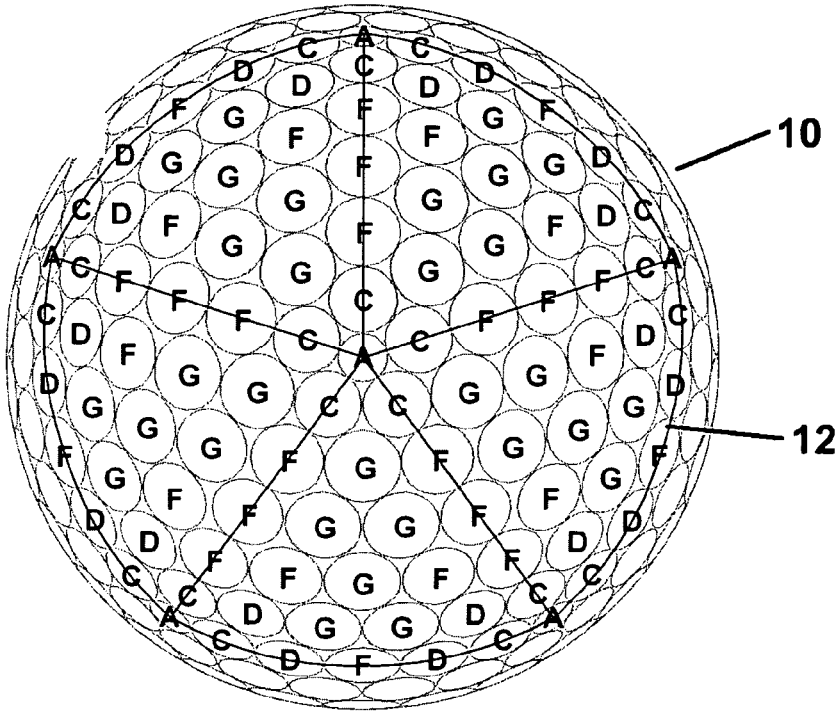
FIG. 3 is a front or polar view of a first embodiment of the present invention and is also a polar view of a modification of the first embodiment.

As shown in FIG. 3 and in accordance to a first embodiment of the present invention, a golf ball 10 comprises a plurality of dimples arranged in an icosahedron pattern. Generally, an icosahedron pattern comprises twenty triangles with five triangles sharing a common vertex coinciding with each pole, and ten triangles disposed between the two five-triangle polar regions. Other suitable dimple patterns include dodecahedron, octahedron, hexahedron and tetrahedron, among others. The dimple pattern may also be defined at least partially by phyllotaxis-based patterns, such as those described in U.S. Pat. No. 6,338,684.

The first embodiment comprises seven different sized dimples, as shown in Table 1 below:

TABLE 1

Dimples and Dimple Pattern of the First Embodiment

| Dimple | Diameter (inch) | Number of Dimples | Surface Coverage % |
|---|---|---|---|
| A | 0.115 | 12 | 1.4 |
| B | 0.155 | 20 | 4.3 |
| C | 0.160 | 40 | 9.1 |
| D | 0.165 | 50 | 12.1 |
| E | 0.170 | 60 | 15.4 |
| F | 0.175 | 80 | 21.8 |
| G | 0.180 | 70 | 20.1 |
| Total | | 332 | 84.2% |

These dimples form twenty triangles 12, with the smallest dimples A occupying the vertices and the largest dimples G occupying most of the interior of the triangle. Three dimples F and two dimples C symmetrically form two sides of the triangle, and a symmetrical arrangement of one dimple F, two dimples D and two dimples C form the remaining side of the triangle, as shown in FIG. 3. In accordance to a first aspect of the first embodiment, ball 10 does not have a great circle that does not intersect any dimple.

Figure 4:
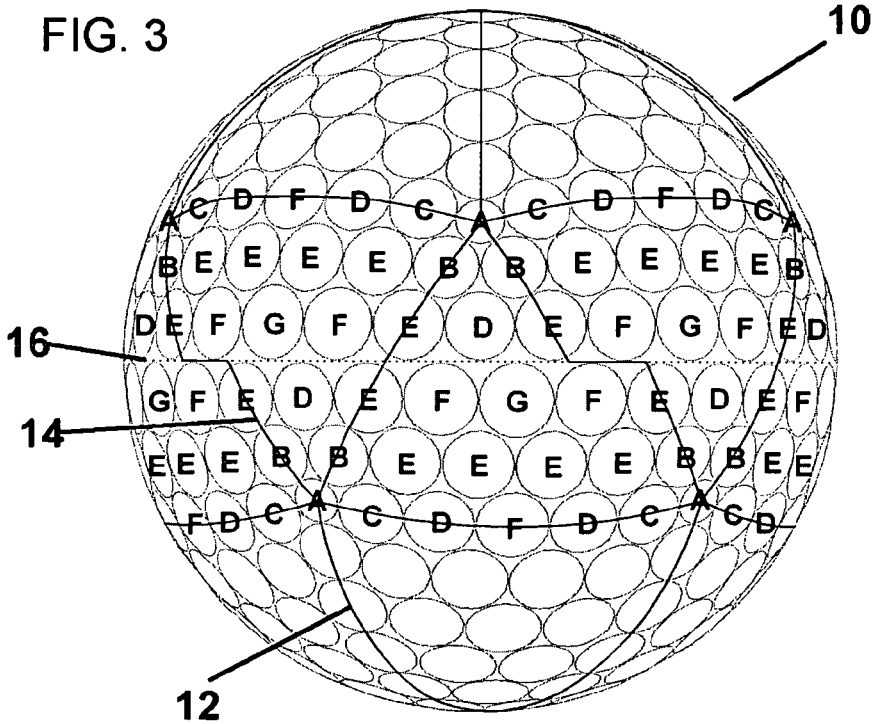
FIG. 4 is an equatorial view of the modification of the first embodiment.

For ease of manufacturing, in accordance to a second aspect of this first embodiment, an equator or parting line is included on the ball's surface. The icosahedron pattern is modified around the midsection to create a great circle that does not intersect any dimple. The dimple arrangement shown in FIG. 3 then illustrates the polar regions of this modification, and the dimple arrangement shown in FIG. 4 illustrates the equatorial region of this modification. The dimple population and surface coverage shown in Table 1 illustrate the dimple arrangement of the modified first embodiment shown in FIGS. 3 and 4.

As shown in FIG. 4, ball 10 comprises ten modified triangles 14 disposed around parting line or equator 16. As shown, each triangle 14 is defined to have smallest dimples A at the vertices and each triangle 14 comprises an arbitrarily defined irregular side. The irregular side can be drawn through other combinations of dimples, and the present invention is not limited to any grouping of modified triangle 14. Additionally, the dimple pattern can be modified to create more than one parting line.

Advantageously, the dimples and dimple pattern of the first embodiment of the present invention increase the aerodynamic efficiency of the golf ball, as shown by the test results below, by combining relatively small number of dimples with multiple sizes to increase dimple coverage. The second embodiment of the present invention shown in FIG. 5 comprises fewer and larger dimples. The second embodiment comprises six different sized dimples, as shown in Table 2 below:

TABLE 2

Dimples and Dimple Pattern of the Second Embodiment

| Dimple | Diameter (inch) | Number of Dimples | Surface Coverage % |
|---|---|---|---|
| A | 0.130 | 12 | 1.8 |
| B | 0.180 | 60 | 17.3 |
| C | 0.195 | 10 | 3.4 |
| D | 0.200 | 90 | 32.0 |
| E | 0.205 | 50 | 18.7 |
| F | 0.210 | 30 | 11.8 |
| Total | | 252 | 84.9% |

Figure 5:
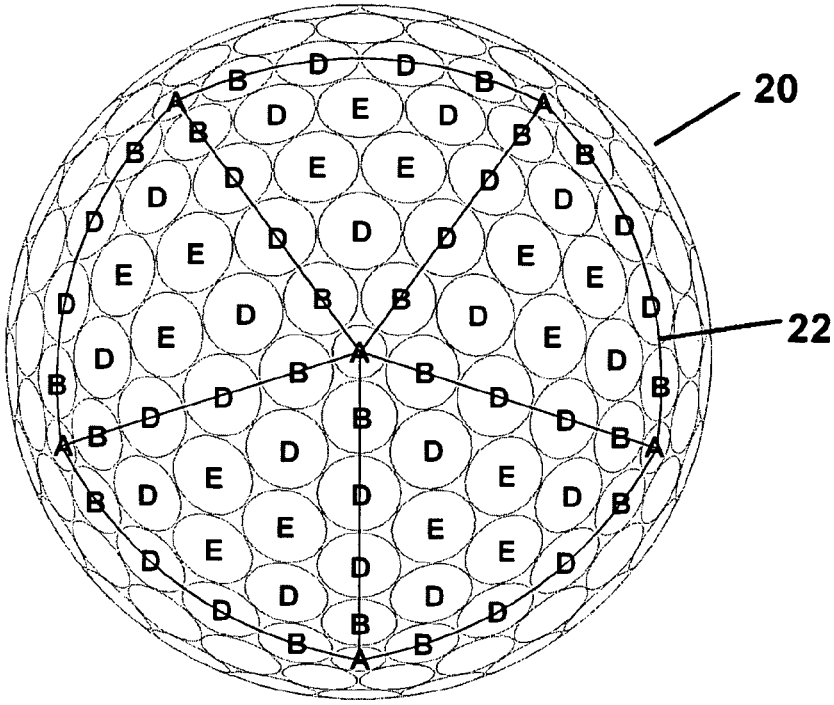
FIG. 5 is a front or polar view of a second embodiment of the present invention and is also a polar view of a modification of the second embodiment.

As shown in FIG. 5, golf ball 20 comprises a plurality of dimples arranged into an icosahedron pattern. Ball 20 comprises twenty triangles 22 with smallest dimples A occupying the vertices of the triangle. Each side of triangle 22 is a symmetrical arrangement of two dimples D and two dimples B. The interior of triangle 22 comprises three dimples D and three dimples E.

Figure 6:
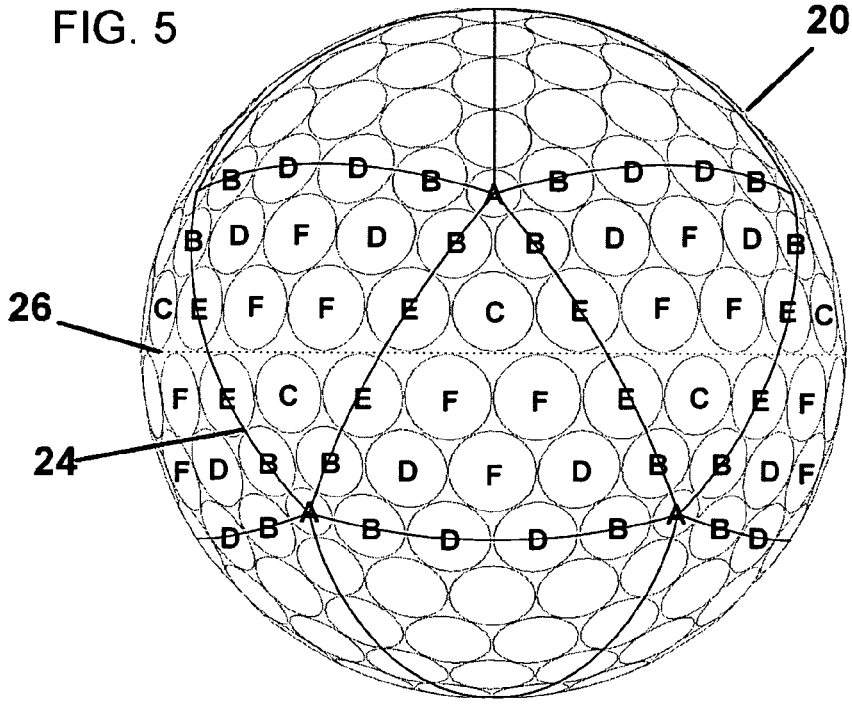
FIG. 6 is an equatorial view of the modification of the second embodiment.

Similarly, ball 20 can be modified to include an equator or parting line on its surface. The icosahedron pattern is modified around the midsection to create a great circle that does not intersect any dimple. The dimple arrangement shown in FIG. 5 then illustrates the polar regions of this modification, and the dimple arrangement shown in FIG. 6 illustrates the equatorial region. The dimple population and surface coverage shown in Table 2 illustrate the dimple arrangement of the modified second embodiment shown in FIGS. 5 and 6. This embodiment comprises only 252 dimples having six different sizes.

As shown in FIG. 6, ball 20 comprises ten modified triangles 24 disposed around parting line or equator 26. As shown, each triangle 24 is defined to have smallest dimples A at the vertices, and unlike triangles 14 each triangle 24 does not have an irregular side. The sizes and positions of the dimples are adjusted so that parting line 26 may pass through triangles 24 without intersecting any dimple. Additionally, the dimple pattern can be modified to create more than one parting line.

In accordance to the present invention and as illustrated above, the dimple count is preferably less than 370 dimples, more preferably less than 350 dimples and most preferably less than 340 dimples. Preferably, more than 75% of the surface of the ball is covered by the dimples. More preferably, more than 80% of the surface is covered and most preferably, more than 83% of the surface is covered. Additionally, preferably two or more sets of different sized dimples are used. More preferably, more than four sets and most preferably six or more sets are used.

The preferred dimple count ranges are significantly less than the current state of the art in dimple designs, and surprisingly, as shown below, exceed the current designs in aerodynamic performance. An additional advantage is that for the same peak angle of trajectory, as defined by the downrange distance at the peak height of flight, the lower dimple count of the present invention generates a shallower angle of descent resulting in a longer roll and longer total distance.

The dimples made in accordance to the present invention preferably have a rounded shape, i.e., the outline that the dimples make on the surface of the ball. Suitable shapes include, but are not limited to, circles, ovals, ellipses, egg-shapes, hexagonal and other polygons with more than six sides. More than one shape may be used on the same dimple pattern. The volume of the dimples is another important aspect of the present invention, as discussed below.

In one embodiment, dimples of the present invention are defined by one revolution of a catenary curve about an axis. A catenary curve represents the curve formed by a perfectly flexible, uniformly dense, and inextensible cable suspended from its endpoints. In general, the mathematical formula representing such a curve is expressed as Equation 11:

$$y=a \cos h(bx) \quad \text{(Eq. 11)}$$

where a=constant b=constant y=vertical axis (on a two dimensional graph)

x=horizontal axis (on a two dimensional graph).

The dimple shape on the golf ball is generated by revolving the catenary curve about its y axis.

This embodiment uses variations of Equation 11 to define the cross-section of golf ball dimples. For example, the catenary curve is defined by hyperbolic sine or cosine functions. A hyperbolic sine function is expressed as Equation 12 below:

$$\sin h(x)=(e^{x}-e^{-x})/2 \quad \text{(Eq. 12)}$$

while a hyperbolic cosine function is expressed by Equation 13:

$$cosh(x)=(e^{x}+e^{-x})/2 \quad \text{(Eq. 13)}$$

In one embodiment, the mathematical equation for describing the cross-sectional profile of a dimple is expressed by Equation 14:

$$Y=(d(\cos h(ax)-1))/(\cos h(ar)-1) \quad \text{(Eq. 14)}$$

where Y=distance from the bottom center of the dimple along the center axis x=radial distance from the center axis of the dimple to the dimple surface a=shape constant (shape factor)

d=depth of dimple r=radius of dimple

The "shape constant" or "shape factor", a, is an independent variable in the mathematical expression for a catenary curve. The shape factor may be used to independently alter the volume ratio of the dimple while holding the dimple depth and radius fixed. The volume ratio is the fractional ratio of the volume enclosed between the dimple chord plane and the dimple surface divided by the volume of a cylinder defined by a similar radius and depth as the dimple.

Use of the shape factor provides an expedient method of generating alternative dimple profiles, for dimples with fixed radii and depth. For example, to design a golf ball with certain lift and drag characteristics, alternative shape factors may be employed to obtain alternative lift and drag performance without having to change dimple pattern, depth or size. No modification to the dimple layout on the surface of the ball is required.

For Equation 14, shape constant values greater than 1 result in dimple volume ratios greater than 0.5. In one embodiment, shape factors are between about 20 to about 100. Table 3 illustrates how the volume ratio changes for a dimple with a radius of 0.05 inches and a depth of 0.025 inches. Increases in shape factor result in higher volume ratios for a given dimple radius and depth.

TABLE 3

Volume Ratio as a Function of Radius and Depth

| SHAPE FACTOR | VOLUME RATIO |
|---|---|
| 20 | 0.51 |
| 40 | 0.55 |
| 60 | 0.60 |
| 80 | 0.64 |
| 100 | 0.69 |

A dimple whose profile is defined by the cosh catenary curve with a shape constant of less than about 40 will have a smaller dimple volume than a dimple with a spherical profile. This will result in a larger aerodynamic force angle and higher trajectory. On the other hand, a dimple whose profile is defined by the cosh catenary curve with a shape constant of greater than about 40 will have a larger dimple volume than a dimple with a spherical profile. This will result in a smaller angle of the aerodynamic force and a lower trajectory. Therefore, a golf ball having dimples defined by a catenary curve with a shape constant is advantageous because the shape constant may be selected to obtain the desired aerodynamic effects.

While this embodiment is directed toward using a catenary curve for at least one dimple on a golf ball, it is not necessary that catenary curves be used on every dimple on a golf ball. In some cases, the use of a catenary curve may only be used for a small number of dimples. It is preferred, however, that a sufficient number of dimples on the ball have catenary curves so that variation of shape factors will allow a designer to achieve the desired aerodynamic characteristics of the ball. In one embodiment, the golf ball has at least about 10 percent, and more preferably at least about 60 percent, of its dimples defined by a catenary curves.

Moreover, it is not necessary that every dimple have the same shape factor. Instead, differing combinations of shape factors for different dimples on the ball may be used to achieve desired ball flight performance. For example, some of the dimples defined by catenary curves on a golf ball may have one shape factor while others have a different shape factor.

Therefore, once a dimple pattern is selected for the golf ball, alternative shape factors for the catenary profile can be tested in light gate test range, as described in U.S. Pat. No. 6,186,002, to empirically determine the catenary shape factor that provides the desired aerodynamic characteristics.

As explained above, the use of various dimple patterns and profiles provides a relatively effective way to modify the aerodynamic characteristics. The use of the catenary curve profile allows a golf ball design to meet any preferred aerodynamic criteria without significantly altering the dimple pattern. Different materials and ball constructions can also be selected to achieve a desired performance.

The present invention may be used with any type of ball construction. For example, the ball may have a 1-piece design, a 2-piece design, a three-piece design, a double core, a double cover, or multi-core and multi-cover construction depending on the type of performance desired of the ball.

Non-limiting examples of these and other types of ball constructions that may be used with the present invention include those described in U.S. Pat. Nos. 5,688,191, 5,713,801, 5,803,831, 5,885,172, 5,919,100, 5,965,669, 5,981,654, 5,981,658, and 6,149,535, as well as in publication no. US2001/0009310 A1. The disclosures of these applications are incorporated by reference herein.

Different materials also may be used in the construction of the golf balls made with the present invention. For example, the cover of the ball may be made of a thermoset or thermoplastic, castable or non-castable polyurethane and polyurea, an ionomer resin, balata, or any other suitable cover material known to those skilled in the art. Different materials also may be used for forming core and intermediate layers of the ball. For example, golf balls having solid, wound, liquid filled, dual cores, and multi-layer intermediate components are contemplated by the invention. For example, the most common core material is polybutadiene, although one of ordinary skill in the art is aware of the various materials that may be used with the present invention. After selecting the desired ball construction, the aerodynamic performance of the golf ball designed to satisfy any desired aerodynamic criteria.

A preferred construction of the golf ball in accordance with the present invention is a four-piece ball comprising a two-layer core and a two-layer cover, such as the ball disclosed in commonly owned co-pending patent application entitled "Thin-layer-covered Multi-layer Golf Ball," bearing Ser. No. 09/782,782 and filed on Feb. 13, 2001. The disclosure of this application is hereby incorporated herein in its entirety. This preferred construction broadly comprises a core and a cover disposed about the core, wherein the core comprises a center and at least one outer core layer adjacent the center, and the cover comprises at least one inner cover layer and an outer cover layer. The center has an outer diameter from about 0.375 inch to about 1.4 inch and, in one embodiment, deflection of greater than about 4.5 mm under a load of 100 Kg. The outer core layer has an outer diameter of from about 1.4 inch to about 1.62 inch. The inner cover layer has an outer diameter of greater than about 1.58 inch and a material hardness of less than about 72 Shore D and the outer cover layer has a hardness of greater than about 50 Shore D, and preferably greater than about 55 Shore D. The inner cover layer outer diameter is preferably from about 1.59 inches to about 1.66 inches, and more preferably from about 1.60 inches to about 1.64 inches. In one embodiment, the outer cover layer has a hardness of less than about 55–60 Shore D. The inner cover layer should have a material hardness between about 60 and about 70 Shore D and, more preferably, between about 60 and about 65 Shore D.

In yet another embodiment, the ball has a moment of inertia of less than about 83 g·cm$^2$. Additionally, the center preferably has a first hardness, the outer core layer has a second hardness greater than the first, and the inner cover layer has a third hardness greater than the second. In a preferred embodiment, the outer cover layer has a fourth hardness less than the third hardness. In one embodiment, the center has a first specific gravity and the outer core layer has a second specific gravity that differs by less than about 0.1. In a preferred embodiment, the center is solid. The center may also be liquid, hollow, or air-filled.

Figure 7:
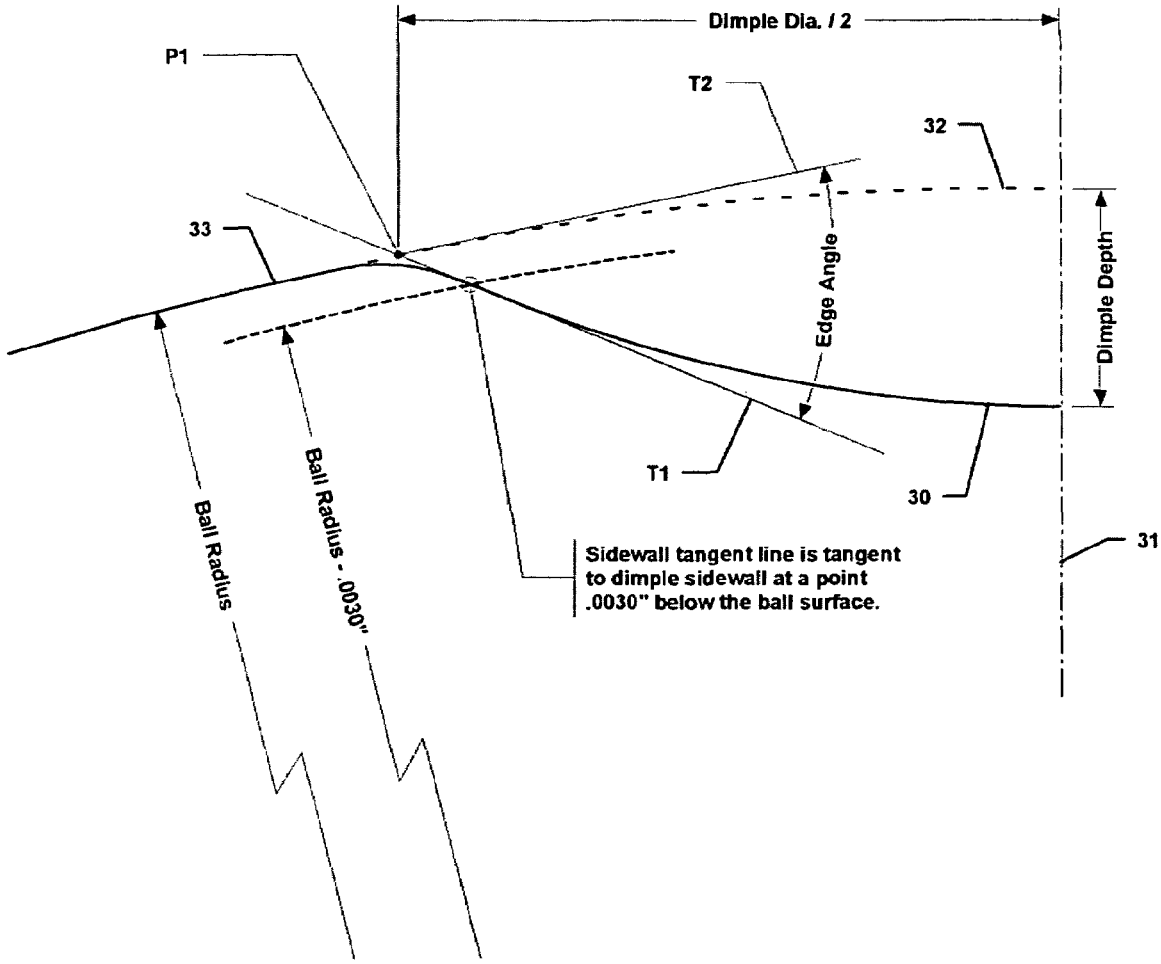
FIG. 7 is a diagram showing how a dimple's edge angle and diameter are measured.

Generally, it may be difficult to define and measure a dimple's edge angle due to the indistinct nature of the boundary dividing the ball's undimpled land surface from the dimple depression itself. FIG. 7 shows a dimple half-profile 30, extending from the dimple centerline 31 to the land surface outside of the dimple 33. Due to the effects of the paint and/or the dimple design itself, the junction between the land surface and the dimple sidewall is not a sharp corner and is therefore indistinct. This makes the measurement of dimple edge angle and dimple diameter somewhat ambiguous. To resolve this problem, the ball phantom surface 32 is constructed above the dimple as a continuation of the land surface 33. A first tangent line T1 is then constructed at a point on the dimple sidewall that is spaced 0.003 inches radially inward from the phantom surface 32. T1 intersects phantom surface 32 at a point P1, which defines a nominal dimple edge position. A second tangent line T2 is then constructed, tangent to the phantom surface 32, at P1. The edge angle is the angle between T1 and T2. The dimple diameter is the distance between P1 and its equivalent point diametrically opposite along the dimple perimeter. Alternatively, it is twice the distance between P1 and the dimple centerline 31, measured in a direction perpendicular to centerline 31.

As mentioned above, the volume of the dimples is an important factor. The volume of a dimple is a function of the shape, the diameter, the depth and the profile of the dimple. The depth is the distance measured along a ball radius from the phantom surface of the ball to the deepest point on the dimple. The profile of the dimple is the cross-sectional shape of the dimple. For example, the volume of the dimple can be defined by the edge angle and the profile. The dimple profile can be circular, triangular, rectangular, polygonal, spherical, parabolic, sinusoidal, elliptical, hyperbolic, or catenary curve, among others.

In accordance to another aspect of the invention, preferably the dimples have a relatively large total dimple volume for the particular shape of the dimple. As used herein, "total dimple volume" is the total volume of material removed from a smooth ball to create the dimpled ball. It is conveniently expressed as a percentage of the total volume of the smooth ball. As shown in Table 4 below, the dimples of ball 10 of the first embodiment preferably occupy at least about 1.50% of the volume of the ball or about 0.0011 cubic inches. A prior art ball having 392 dimples of similar shape, such as the Titleist Pro-V1, has a dimple volume of less than 1.40%.

TABLE 4

Dimples and Dimple Pattern of the First Embodiment

| Dimple Type | Dimple Diameter (inch) | Dimples per Ball | Vol. Per Dimple (inch$^3$) | Volume % | Coverage % |
|---|---|---|---|---|---|
| A | 0.115 | 12 | 0.000034–0.000037 | 0.01 | 1.4 |
| B | 0.155 | 20 | 0.000090 | 0.07 | 4.3 |
| C | 0.160 | 40 | 0.000091–0.000099 | 0.16 | 9.1 |
| D | 0.165 | 50 | 0.000108 | 0.22 | 12.1 |
| E | 0.170 | 60 | 0.000118 | 0.29 | 15.4 |
| F | 0.175 | 80 | 0.000120–0.000129 | 0.41 | 21.8 |
| G | 0.180 | 70 | 0.000130–0.000140 | 0.39 | 20.2 |
| Total | | 332 | 0.001095 | 1.55 | 84.2 |

The dimples of ball 20 of the second embodiment listed in Table 2 above having similar edge angles occupy about 1.81% of the volume of the ball, or about 0.00135 cubic inch, as shown in Table 5 below.

TABLE 5

Dimples and Dimple Pattern of the Second Embodiment

| Dimple Type | Dimple Diameter (inch) | Dimples per Ball | Vol. Per Dimple ($inch^3$) | Volume % | Coverage % |
|---|---|---|---|---|---|
| A | 0.130 | 12 | 0.00005 | 0.02 | 1.8 |
| B | 0.180 | 60 | 0.00013–0.00014 | 0.33 | 17.3 |
| C | 0.195 | 10 | 0.00018 | 0.07 | 3.4 |
| D | 0.200 | 90 | 0.00018–0.00019 | 0.69 | 32.0 |
| E | 0.205 | 50 | 0.00021 | 0.42 | 18.7 |
| F | 0.210 | 30 | 0.00022 | 0.27 | 11.8 |
| Total | | 252 | 0.00135 | 1.81 | 84.9 |

Preferably, all the dimples occupy at least about 1.25% or more of the total volume of the ball, and more preferably at least about 1.5%. In some cases, the dimples may occupy more than about 2% of the volume of the ball.

Five prototypes of golf ball 10 in accordance with the first embodiment (332 dimples), Nos. 1–5 respectively, were made. The total dimple volumes of these prototypes are varied in decreasing order, e.g., the No. 1 prototype possesses the highest total dimple volume and No. 5 prototype possesses the lowest volume. The dimples on prototype Nos. 2 and 3 have similar profiles, but No. 2 has a slightly higher total dimple volume. The dimples on No. 4 and 5 prototypes have similar profiles, but No. 4 prototype has a slightly higher total dimple volume. Additionally, the No. 2 prototype has the dimple volumes described in Table 4, above. These prototypes were tested and compared to a number of commercially available balls.

The physical properties of the balls tested are shown in Table 6 below.

TABLE 6

| | PGA Compression | Weight (ounces) | Cover Hardness (shore D) | Coefficient of Restitution |
|---|---|---|---|---|
| Ball Tested | | | | |
| Pinnacle Gold Distance* | 88 | 1.606 | 68 | 0.802 |
| Titleist Pro V1 | 86 | 1.607 | 57 | 0.808 |
| Titleist Pro V1 STAR | 88 | 1.609 | 59 | 0.794 |
| Callaway CTU Red | 100 | 1.613 | 59 | 0.801 |
| Callaway HX Red | 102 | 1.616 | 59 | 0.803 |
| PROTOTYPES | | | | |
| No. 1 | 102 | 1.607 | 60 | 0.810 |
| No. 2 | 101 | 1.610 | 60 | 0.809 |
| No. 3 | 101 | 1.611 | 60 | 0.809 |
| No. 4 | 101 | 1.614 | 60 | 0.808 |
| No. 5 | 100 | 1.613 | 60 | 0.809 |

(*= USGA standard golf ball)

The Coefficient of Restitution was measured by firing the ball into a massive steel target at a nominal speed of 125 feet per second, while measuring the actual speeds just before and just after impact. The Coefficient of Restitution is the ratio of the post-impact relative speed to the pre-impact relative speed.

These balls were first tested at very high impact speeds that would produce an initial velocity of about 175 miles per hour for the balls and at a launch angle of about 10°. The specific impact conditions for each ball are shown in Table 7 below.

TABLE 7

| | Launch ± σ (degrees) | Spin ± σ (rev/min) | Speed ± σ (mph) | Number of Hits |
|---|---|---|---|---|
| Ball Tested | | | | |
| Pinnacle Gold Distance | 10.1 ± 0.3 | 2649 ± 221 | 176.0 ± 1.2 | 12 |
| Titleist Pro V1 | 9.8 ± 0.3 | 2940 ± 162 | 176.2 ± 1.0 | 12 |
| Titleist Pro V1 STAR | 9.9 ± 0.3 | 2798 ± 104 | 175.1 ± 1.1 | 11 |
| Callaway CTU Red | 9.8 ± 0.3 | 2970 ± 101 | 177.0 ± 1.2 | 12 |
| Callaway HX Red | 9.9 ± 0.3 | 2902 ± 116 | 177.0 ± 0.7 | 12 |
| PROTOTYPES | | | | |
| No. 1 | 9.9 ± 0.3 | 2748 ± 157 | 177.9 ± 0.6 | 12 |
| No. 2 | 10.0 ± 0.3 | 2747 ± 109 | 178.0 ± 0.8 | 12 |
| No. 3 | 9.9 ± 0.2 | 2810 ± 158 | 178.1 ± 1.0 | 11 |
| No. 4 | 10.0 ± 0.3 | 2760 ± 110 | 178.0 ± 0.8 | 12 |
| No. 5 | 10.0 ± 0.3 | 2757 ± 164 | 177.7 ± 0.3 | 12 |

Where, σ denotes one standard deviation from the statistical analysis based on the number of hits for each ball.

The distances that the balls traveled after impact are listed in Table 8 below. Distances are recorded in yards. Carry distance is the distance the ball traveled in flight, and the roll distance is the distance the ball rolls or bounces after landing. The total distance is the sum of carry distance and roll distance.

TABLE 8

| | Carry Distance | Roll Distance | Total Distance |
|---|---|---|---|
| Ball Tested | | | |
| Pinnacle Gold Distance | 283.9 | 8.9 | 292.8 |
| Titleist Pro V1 | 282.7 | 6.3 | 289.0 |
| Titleist Pro V1 STAR | 281.9 | 9.6 | 292.5 |
| Callaway CTU Red | 283.5 | 6.0 | 289.6 |
| Callaway HX Red | 284.4 | 7.0 | 291.4 |
| PROTOTYPES | | | |
| No. 1 | 281.3 | 12.4 | 293.7 |
| No. 2 | 289.6 | 9.4 | 299.0 |
| No. 3 | 287.7 | 8.1 | 295.8 |
| No. 4 | 288.6 | 8.3 | 296.8 |
| No. 5 | 284.5 | 8.0 | 292.5 |

The results clearly show that the prototypes of the present invention enjoy significantly improved total distance traveled at initial ball speed of greater than 170 miles per hour or about 175 miles per hour over the commercially available golf balls. Importantly, when the prototypes are compared to the CTU Red and HX Red balls, which have substantially the same compression as the prototypes, the prototypes displayed significant advantage in total distance traveled. More particularly, the No. 2 and 4 prototypes exhibit the highest total distances of 299 yards and 296.8 yards, respectively. Significantly, these balls also exhibit the best carry distances of 289.6 yards and 288.6 yards, respectively.

This distance advantage at high initial velocity after impact is very helpful to today's professional golfers who can drive the balls at this high initial ball speed. Importantly, at lower speed the prototypes of the present invention display similar performance as the commercially available balls, as shown in Tables 9 and 10 below.

TABLE 9

| Ball Tested | Launch ± σ (degrees) | Spin ± σ (rev/min) | Speed ± σ (mph) | Number of Hits |
|---|---|---|---|---|
| Pinnacle Gold Distance | 9.8 ± 0.3 | 2912 ± 124 | 158.5 ± 0.5 | 12 |
| Titleist Pro V1 | 9.4 ± 0.2 | 3283 ± 110 | 159.3 ± 0.5 | 11 |
| Titleist Pro V1 STAR | 9.6 ± 0.2 | 3079 ± 102 | 157.8 ± 0.6 | 10 |
| Callaway CTU Red | 9.3 ± 0.2 | 3366 ± 98 | 158.9 ± 0.3 | 12 |
| Callaway HX Red | 9.5 ± 0.3 | 3250 ± 93 | 158.9 ± 0.4 | 12 |
| PROTOTYPES | | | | |
| No. 1 | 9.7 ± 0.2 | 3051 ± 172 | 159.6 ± 0.5 | 11 |
| No. 2 | 9.6 ± 0.2 | 3092 ± 105 | 159.8 ± 0.5 | 12 |
| No. 3 | 9.6 ± 0.3 | 3087 ± 95 | 159.4 ± 0.5 | 11 |

TABLE 10

| Ball Tested | Carry Distance | Roll Distance | Total Distance |
|---|---|---|---|
| Pinnacle Gold Distance | 256.5 | 14.1 | 270.6 |
| Titleist Pro V1 | 254.6 | 10.8 | 265.5 |
| Titleist Pro V1 STAR | 253.9 | 18.4 | 272.4 |
| Callaway CTU Red | 255.5 | 10.3 | 265.8 |
| Callaway HX Red | 256.6 | 11.6 | 268.2 |
| No. 1 | 253.6 | 16.9 | 270.6 |
| No. 2 | 258.9 | 9.6 | 268.5 |
| No. 3 | 258.6 | 11.8 | 270.5 |

Hence, the dimples and dimple patterns in accordance to the present invention are also suitable for more typical swing speeds, and are comparable to the commercial golf balls at initial ball speed of about 160 miles per hour.

In accordance to another aspect of the present invention, the inventive dimples and dimple patterns also exhibit improved aerodynamic characteristics compared to those of commercial golf balls. It has been discovered by the inventors of the present invention that during the flight of a golf ball, it is more advantageous to have a relatively low lift coefficient, $C_L$, during the ascent of the flight so that the ball travels further and may have more roll. On the other hand, it is more advantageous to have a relatively higher. $C_L$ during the descent of the flight to maximize the carry distance.

In the tests described in Tables 11 and 12 below, the aerodynamic characteristics of two preferred prototypes of the present invention, No. 2 and No. 4, are compared to those of commercially available golf balls. For these tests, Reynolds Number, $N_{RE}$, of about 70,000 with spin ratio, SR of about 0.188, is an approximation of lower velocity flight, such as the velocity during the descent. On the other hand, $N_{RE}$ of about 180,000 with spin ratio of about 0.110 represents a higher velocity flight, such as the velocity during the ascent.

The average lift coefficients for these balls are summarized in Table 11 below.

TABLE 11

Average Lift Coefficients

| | Avg. $C_L$ at Re 70,000 and 0.188 SR | Avg. $C_L$ at Re 180,000 and 0.110 SR | $C_L$ at Re 180,000/ $C_L$ at Re 70,000 |
|---|---|---|---|
| BALL | | | |
| Pinnacle Gold | 0.216 | 0.158 | 0.733 |
| Pro V1 | 0.209 | 0.168 | 0.803 |
| Pro 2p** | 0.232 | 0.174 | 0.752 |
| HX Red | 0.215 | 0.179 | 0.830 |
| Rule 35 Red | 0.227 | 0.177 | 0.778 |
| PROTOTYPES | | | |
| No. 2 | 0.244 | 0.168 | 0.691 |
| No. 4 | 0.207 | 0.173 | 0.832 |

(**= the Pro 2p is a solid core with polyurethane cover golf ball commercialized in or around 1995.)

The average drag coefficients are summarized in Table 12 below.

TABLE 12

Average Drag Coefficients

| | Avg. $C_D$ at Re 70,000 and 0.188 SR | Avg. $C_D$ at Re 180,000 and 0.110 SR | $C_D$ at Re 180,000/ $C_D$ at Re 70,000 |
|---|---|---|---|
| BALL | | | |
| Pinnacle Gold | 0.276 | 0.225 | 0.815 |
| Pro V1 | 0.274 | 0.227 | 0.828 |
| Pro 2p | 0.288 | 0.231 | 0.802 |
| HX Red | 0.282 | 0.228 | 0.809 |
| Rule 35 Red | 0.284 | 0.227 | 0.799 |
| PROTOTYPES | | | |
| No. 2 | 0.286 | 0.228 | 0.797 |
| No. 4 | 0.270 | 0.227 | 0.841 |

The average magnitudes of aerodynamic forces are summarized in Table 13 below.

TABLE 13

Average Magnitudes of Aerodynamic Forces

| | Avg. $C_{MAG}$ at Re 70,000 and 0.188 SR | Avg. $C_{MAG}$ at Re 180,000 and 0.110 SR | $C_{MAG}$ at Re 180,000/ $C_{MAG}$ at Re 70,000 |
|---|---|---|---|
| BALL | | | |
| Pinnacle Gold | 0.351 | 0.275 | 0.784 |
| ProV1 | 0.345 | 0.282 | 0.817 |
| Pro 2p | 0.369 | 0.289 | 0.783 |
| HX Red | 0.355 | 0.290 | 0.817 |
| Rule 35 Red | 0.364 | 0.287 | 0.789 |
| PROTOTYPES | | | |
| No. 2 | 0.376 | 0.284 | 0.755 |
| No. 4 | 0.340 | 0.285 | 0.838 |

The average lift coefficients, $C_L$, average drag coefficient, $C_D$, and aerodynamic force coefficients, $C_{MAG}$, are obtained from measuring the coefficients in the PH and PP orientations and averaging these two values. Additionally, the coefficients for the Titleist® Pro V1 ball are the average of several tests conducted at different times. At least one of the Pro V1 tests were conducted contemporaneously with the testing of the prior art balls listed above, and some of the Pro V1 tests were conducted contemporaneously with the prototypes. The Pro V1 ball is utilized as the standard that the other golf balls are compared to.

The inventors of the present invention have also found that a useful ratio of $C_L$ (at Re 180,000/$C_L$ and SR of 0.110) to $C_L$ (at Re 70,000 and SR of 0.188) embodies the preferred lower lift coefficient during the ascent and the preferred higher lift coefficient during the descent. More specifically, this ratio for the No. 2 prototype, which is less than about 0.730, preferably less than about 0.725 and more preferably less than 0.700, represents the best of both worlds, i.e., low $C_L$ during the ascent and high $C_L$ during the descent. The No. 2 prototype also exhibits the longest total distance traveled when impacted by a driver club sufficient to generate about 175 mph initial ball speed, as discussed above in Table 8. Such advantageous results can be attributed to the lower dimple count, the high dimple coverage and the multiple sizes of the dimples. The ratio of $C_L$ at Re 180,000 and SR of 0.110 to $C_L$ at Re 70,000 and SR of 0.188 less than 0.725 does not exist in any of the commercially available golf balls, heretofore. Among the tested commercially available balls, the USGA standard Pinnacle Gold has lowest ratio of $C_L$ at Re 180,000/$C_L$ at Re 70,000 of 0.733.

On the other hand, the No. 4 prototype, while exhibiting the second longest total distance traveled when impacted by a driver club sufficient to generate about 175 mph initial velocity, as discussed above in Table 8, does not have a favorable ratio of $C_L$ at Re 180,000 and SR of 0.110 to $C_L$ at Re 70,000 and SR of 0.188, suggesting the importance of high total dimple volume to the lift coefficient. Moreover, the $C_D$ values of the No. 4 prototype, as shown in Table 12 above, show that while the No. 4 prototype has nearly identical $C_D$ at Re 180,000 and SR of 0.110 as the No. 2 prototype, the No. 4 prototype exhibits significantly lower $C_D$ at Re 70,000 and SR of 0.188 than the No. 2 prototype as well as the tested commercially available balls. This is an indication that the No. 4 prototype possesses favorable flight characteristics in the mid-Reynolds Number region. As shown in the test data, the No. 4 prototype enjoys the second longest carry distance and the second longest total distance of all the balls tested.

The test results also show that the ratio of $C_{MAG}$ at Re 180,000 and SR of 0.110 to $C_{MAG}$ at Re 70,000 and SR of 0.188 for the present invention is advantageously below about 0.7800 and more preferably below 0.7600.

While it is apparent that the illustrative embodiments of the invention herein disclosed fulfill the objectives stated above, it will be appreciated that numerous modifications and other embodiments may be devised by those skilled in the art. Elements or components of each illustrative embodiment can be used singly or in combination with other embodiments. Therefore, it will be understood that the appended claims are intended to cover all such modifications and embodiments which come within the spirit and scope of the present invention.

What is claimed is:

1. A golf ball having an outer surface, wherein the outer surface comprises less than about 370 dimples covering at least about 80% of the outer surface of the golf ball and wherein the dimples comprise at least two sizes and the golf ball has lift coefficient at Reynolds Number of 180,000 and spin ration of 0.110 of about 0.170 or less.

2. The golf ball of claim 1, wherein the golf ball comprises less than 350 dimples.

3. The golf ball of claim 2, wherein the golf ball comprises less than 340 dimples.

4. The golf ball of claim 3, wherein the golf ball comprises about 250 dimples.

5. The golf ball of claim 4, wherein the dimples cover at least about 83% of the surface of the ball.

6. The golf ball of claim 5, wherein the dimples comprise at least four sizes.

7. The golf ball of claim 6, wherein the dimples comprise at least six sizes.

8. A golf ball having an outer surface, wherein the outer surface comprises less than about 370 dimples and wherein the total dimple volume is at least about 1.5% and the golf ball has a drag coefficient at Reynolds Number of 70,000 and spin ratio of 0.188 of about 0.270 or less.

9. The golf ball of claim 8, wherein the golf ball comprises less than 350 dimples.

10. The golf ball of claim 9, wherein the golf ball comprises less than 340 dimples.

11. The golf ball of claim 10, wherein the golf ball comprises less than 300 dimples.

12. The golf ball of claim 11, wherein the golf ball comprises about 250 dimples.

13. The golf ball of claim 8, wherein the dimples cover at least about 75% of the outer surface of the ball.

14. The golf ball of claim 13, wherein the dimples cover at least about 80% of the outer surface of the ball.

15. The golf ball of claim 14, wherein the dimples cover at least about 83% of the surface of the ball.

* * * * *